US005720264A

United States Patent [19]

Oosuka et al.

[11] Patent Number: 5,720,264

[45] Date of Patent: Feb. 24, 1998

[54] IGNITION COIL HAVING A HOUSING MADE OF REINFORCED PPS

[75] Inventors: Kazutoyo Oosuka, Gamagori; Katsuhisa Kato, Kariya; Masami Kojima, Chiryu, all of Japan

[73] Assignee: Denso Corporation, Kariya, Japan

[21] Appl. No.: 777,981

[22] Filed: Dec. 24, 1996

[30] Foreign Application Priority Data

Dec. 26, 1995 [JP] Japan ..... 7-339206

[51] Int. Cl.[6] ..... F02P 15/00

[52] U.S. Cl. ..... 123/634; 123/169 PA

[58] Field of Search ..... 123/634, 635, 123/169 PA, 647; 336/58, 94

[56] References Cited

U.S. PATENT DOCUMENTS 4,617,907 10/1986 Johansson et al. ..... 123/647
5,476,695 12/1995 Okada et al. ..... 428/1

FOREIGN PATENT DOCUMENTS 3-043259 4/1991 Japan .
7-085908 3/1995 Japan .

*Primary Examiner*—Willis R. Wolfe
*Assistant Examiner*—Hien T. Vo
*Attorney, Agent, or Firm*—Cushman, Darby & Cushman IP Group of Pillsbury, Madison & Sutro LLP

[57] ABSTRACT

An ignition coil for an internal combustion engine, includes a housing to be mounted in on the internal combustion engine and a coil portion dipped in an insulating oil filled in the housing. The housing is molded of a material containing any selected from the group consisting of polyphenylene sulfide, polyphenylene oxide, polyarylate, polyether imide and a liquid crystal polymer, and a reinforcing filler is added to the material.

9 Claims, 4 Drawing Sheets

FIG. 3

TABLE

| CHARACTERISTICS | MEASURING CONDITION | TARGET | EXAMPLE 1 | EXAMPLE 2 | COMPARISON 1 | COMPARISON 2 | COMPARISON 3 | COMPARISON 4 |
|---|---|---|---|---|---|---|---|---|
| | | | PPS G15 | PPS G40 | PPS NO FIBER | PPS FILLER 60 | PBT G30 | NY66 G30 |
| TENSIL STRENGTH [Kg/cm²] | ASTM D638 | ABOVE 800 | 900 | 1800 | 500 | 1500 | 1100 | 1800 |
| THERMAL DEFORMATION TEMP. [°C] | ASTM D648 4.6Kg/mm² | ABOVE 200 | 240 | ABOVE 250 | 180 | 260 | 210 | 262 |
| MELTING POINT [°C] | — | — | ABOUT 270 | ABOUT 270 | ABOUT 270 | ABOUT 280 | ABOUT 220 | ABOUT 265 |
| COMBUSTIBILITY | UL94 | | V-0 | V-0 | V-0 | V-0 | HB | HB |
| MOLDING | TWO POINT GATE | | ○ | △ | — | X | ○ | △ |
| | FOUR POINT GATE | | ○ | ○ | — | △ | ○ | ○ |
| ADHESION WITH EPOXY | — | | X | X | X | X | ○ | X |
| HIGH TEMPERATURE DIELECTRIC DURABILITY (Hr) | | 1000 | ABOVE 1000 | — | — | — | 200 ~400 | BELOW 200 |

IGNITION COIL HAVING A HOUSING MADE OF REINFORCED PPS

BACKGROUND OF THE INVENTION

1. Field of the Invention

The present invention relates to an ignition coil for an internal combustion engine.

2. Related Art

The ignition coil of the prior art is filled up around a coil portion, as fitted in a housing, with a thermoset resin (molding resin) such as an epoxy resin so as to prevent the high voltage, as generated by the coil portion, from leaking out of the housing and a dielectric breakdown from being caused in the coil by the high voltage. Considering the adhesion between the inner wall of the housing and the molding resin, therefore, it is known to make the housing of a thermoplastic polyester resin such as polybutylene terephthalate (PBT) or polyethylene terephthalate (PET).

From the view point of the problem that the high voltage leaks out of the housing, on the other hand, the ignition plug cap and the high-tension body cord cap using polyphenylene sulfide (PPS) are disclosed in Japanese Patent Laid-Open No. 85908/1995 and Japanese Utility Model Laid-Open No. 43259/1991 to have better dielectric durabilities than those using the PBT, the PET and so on.

It is, therefore, conceivable to use the PPS in place of the PBT and the PET in the housing of the ignition coil. If, however, the PPS is used in the housing of the ignition coil, the dielectric durability of the housing itself is improved, but the adhesion in the interface between the PPS and the epoxy resin is so low that a gap or crack is established between the inner wall of the housing and the molding resin of the PPS thereby to cause a problem that the high-tension leakage is liable to occur.

When the housing is formed into such a cylindrical shape that it can be fitted in the plug hole, the housing may lose its shape holdability to be broken or deformed in a high-temperature circumstance such as the overheat of the internal combustion engine.

SUMMARY OF THE INVENTION

An object of the present invention is to provide an ignition coil for an internal combustion engine, which is improved in its dielectric durability in the high-temperature circumstance.

An ignition coil according to the present invention uses the PPS as the material for a housing of an ignition coil, then durability can be improved better than the structure which uses the PBT or PET. By adding a reinforcing filler, moreover, it is possible to enhance the strength in the high-temperature circumstance. This raises an effect that the dielectric durability in the high-temperature circumstance can be improved.

The housing has a secondary voltage output portion insulated therearound by a joint portion which is integrated with the housing. As a result, there can be attained an effect that the amount of expensive silicone rubber to be used is reduced, as compared with the construction in which the joint portion is made of the silicone rubber or the like separately of the housing.

The housing also has such a cylindrical shape that it can be fitted in the plug hole so that the ignition coil can be mounted in the plug hole. Hence, even if the internal combustion engine is overheated, for example, the strength in the high-temperature circumstance is enhanced to provide an effect that the housing breakage is prevented at the relatively thin cylindrical portion.

The PPS, as contained in the housing material, has a thermal deformation temperature of 200° C. or higher under the condition of 4.6 Kg/cm$^2$ according to the D648 of American Society for Testing Materials (as will be called the "ASTM"). As a result, there can be achieved an effect that it is possible to prevent the breakage of the relatively thin cylindrical portion, as is liable to occur when the ignition coil is extracted from the plug hole in the circumstance as high as or higher than 200° C.

Further, the reinforcing filler to be added to the PPS is in the amount of 15 to 40 weight % so that the shape holdability of the housing can be retained even in the high-temperature circumstance such as the overheat of the internal combustion engine. Since, moreover, the filler is reduced, as compared with the ordinary high filling, there can be achieved an effect that the housing containing the additional reinforcing filler can be injection-molded without any increase in the gate number of the injection mold.

The present invention uses insulating oil as the insulating material for dipping the coil portion therein so that a material having excellent electric characteristics can be selected as the housing material without any restriction upon the adhesion to the insulating material filling the housing. The suitable material is the PPS, for example.

BRIEF DESCRIPTION OF THE DRAWINGS

Other objects, features and advantages of the present invention will be made more apparent by the following detailed description with reference to the accompanying drawings, in which:

FIG. 3 is a table tabulating the test results obtained by the testing system of FIG. 2.

DESCRIPTION OF THE PREFERRED EMBODIMENT

An embodiment of the present invention will be described in the following with reference to the accompanying drawings.

Figure 1:
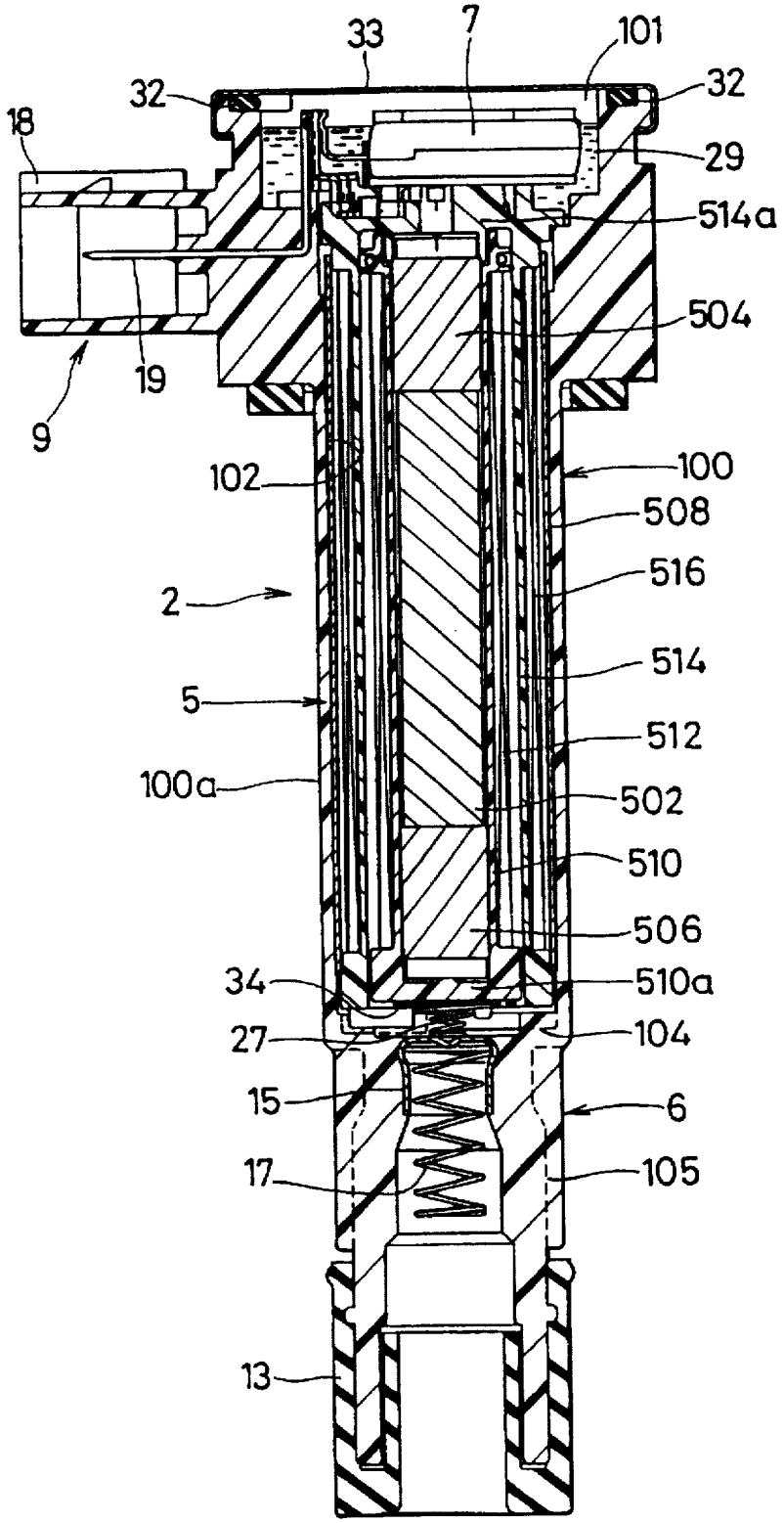
FIG. 1 is a longitudinal sectional view showing an ignition coil according to one embodiment of the present invention.

As shown in FIG. 1,.an ignition coil 2 is so constructed that it can be fitted in a plug hole, as formed in the upper portion of a not-shown engine body, for each of engine cylinders. The ignition coil 2 is constructed mainly of: a cylindrical transformer portion 5; a control circuit portion 7 positioned at one end (top) portion of the transformer portion 5 for interrupting the primary current of the transformer portion 5; a case 100 for fitting those transformer portion 5 and control circuit portion 7 and so on; and a joint portion 6 positioned at the other end (bottom) portion of the transformer portion 5 for feeding the secondary voltage of the transformer portion 5 to the not-shown ignition plug.

The case 100 acting as the housing is made of a PPS satisfying the later-described material characteristics and glass fibers acting as a filler and is formed into a cylindrical shape integrally with the joint portion 6 by the later-described injection molding method. This case 100 is molded of a resin into a monolayer cylinder at its portions excepting its upper and lower ends, and the cylindrical wall defining the outer circumference of a fitting chamber 102 is molded to have a smaller thickness. In the fitting chamber 102 defined by the inner side of the case 100, moreover, there is confined the insulating oil 29 which fills up the transformer portion 5 acting as the coil portion and the portions around control circuit portion 7 and the transformer portion 5. The fitting chamber 102 is equipped at its upper end portion with a control signal inputting connector 9 and at its lower end portion with a bottom portion 104 which is closed by the bottom portion of a later-described cup 15. The outer circumferential wall of the cup 15 is covered with the joint portion 6 which is located at the lower end of the case 100.

In the joint portion 6, there is formed a cylindrical portion 105 at which the not-shown ignition plug is fitted in the case 100. In the open end of this cylindrical portion 105, there is mounted a plug cap 13 made of rubber. In the bottom portion 104, as located at the upper end of the cylindrical portion 105, the metallic cup 15 is insert-molded in the resin material of the case 100. As a result, the fitting chamber 102 and the joint portion 6 are liquid-tight partitioned from each other.

A spring 17, as retained in the bottom portion of the cup 15, is a compression coil spring, the other end portion of which is to have electric contact with the electrode portion of the not-shown ignition plug to be inserted into the joint portion 6. Here, the cup 15 and the spring 17 correspond to a secondary voltage outputting portion.

The control signal inputting connector 9 is composed of a connector housing 18 and connector pins 19. The connector housing 18 is integrally or monolithically molded with the case 100, and the three connector pins 19, as positioned in the connector housing 18, are so insert-molded in the connector housing 18 that they are extended through the case 100 and can be connected with the outside.

In the upper side of the case 100, as viewed in FIG. 1, there is formed a large opening 101 for inserting the transformer portion 5, the control circuit portion 7, the insulating oil 29 and so on into the fitting chamber 102 from the outside of the case 100. The opening 101 is liquid-tightly closed by caulking and fixing a metallic cover 33 on the upper portion of the case 100 through an O-ring 32.

The transformer portion 5 is composed of an iron core 502, magnets 504 and 506, a secondary spool 510, a secondary coil 512, a primary spool 514 and a primary coil 516.

The iron core 502 having a cylindrical shape is assembled by wrapping thin silicon steel sheets into a shape having a generally circular section. To the two ends of the iron core 502, there are individually fixed by adhesive tapes the magnets 504 and 506 which are given the polarity opposite to the direction of the magnetic flux, as energized by the coil.

The secondary spool 510, as molded of a resin, is formed into a bottomed cylindrical shape having flanges at its two end portions and is substantially closed at its lower end portion by a bottom portion 510*a*. The iron core 502 and magnet 506 are fitted in the secondary spool 510, which is wound therearound with the secondary coil 512.

On the bottom portion 510*a*, there is fixed a terminal plate 34 acting as a secondary voltage output portion, with which is electrically connected one end of the secondary coil 512. On this terminal plate 34, there is fixed a spring 27 for contacting with the cup 34. These terminal plate 15 and spring 27 function as a spool side conductive member so that the high voltage, as induced in the secondary coil 512, is fed to the electrode portion of the not-shown ignition plug through the terminal plate 34, the spring 27, the cup 15 and the spring 17.

The primary spool 514, as molded of a resin, is substantially closed at its upper end portion by the cover portion 514*a* and is wound therearound with the primary coil 516. Moreover, the primary spool 514 covers the secondary coil 512 which is wound around the secondary spool 510. As a result, the iron core 502, as equipped with the magnets 504 and 506 at its two ends, is clamped between the cover portion 514*a* of the primary spool 514 and the bottom portion 510*a* of the secondary spool 510.

Around the primary spool 514, furthermore, there is mounted an auxiliary core 508 which is formed into such a cylindrical shape as not to connect the wrapping start end and the terminal end of the thin silicon steel sheets. This arrangement reduces the short-circuit current which is established in the circumferential direction of the auxiliary core 508.

The insulating oil 29, as filling up the inside of the fitting chamber 102, ensures the electric insulations among the iron core 502, the secondary coil 512, the primary coil 516 and the auxiliary core 508 as it invades into the lower open end of the primary spool 514, the opening formed in the central portion of the upper cover portion 514*a* of the primary spool 514, the upper open end of the secondary spool 514 and the opening formed in the outer circumferential wall of the lower portion of the secondary spool 510. By filling up the fitting chamber 102 with the insulating oil 29, on the other hand, the insulating oil 29 in the liquid or fluid state is caused to wet the inner wall of the case 100 thereby to eliminate such a gap in the interface between the inner wall of the case 100 and an injected resin as may be established if the molding resin is exemplified by an epoxy resin. As a result, the secondary voltage, as generated by the transformer portion 5, is effectively suppressed by the insulating oil 29 from the high-tension leakage through the case 100 to the plug tube or the like.

The material characteristics of the above-specified case 100 will be described with reference to Table shown in FIG. 3.

Here: the "PPS G15" in Example 1 designate the PPS containing 15 weight % of glass fibers added; the "PPS G40" in Example 2 designate the PPS containing 40 weight % of glass fibers added; and the "PBT G30" in Example 3 designate the PBT containing 30 weight % of glass fibers added. Moreover, the "ASTM D638" designate the standard testing method D638, as regulated by ASTM, and the "ASTM D648" designate the standard testing method D648, as likewise regulated. In addition, the "UL94" designate the horizontal combustibility test 94HB and the vertical combustibility test 94V, as regulated by the UL standards of the U.S.A.

It is understood from Table that Examples 1 and 2 are higher in the thermal deformation temperature than Comparison 1 because a predetermined amount of glass fibers is added. Moreover, Example 1, to which the glass fibers are added at as small as 15 weight % of glass fibers, is higher in the thermal deformation temperature than Comparison 2 of PBT, to which 30 weight % of glass fibers are added. This is because the PPS has a melting point higher by about 50° C. than that of the PBT. As a result, even in the high-temperature circumstance such as in the overheat of the internal combustion engine, a satisfactory shape holdability can be given to the case 100 so that the thermal deformation can be prevented especially in the thin portion 100*a* of the case 100 or the relatively thin portion.

It is also understood from Table that the tensile strength increases with the increase in the addition of the glass fibers. As a result, the tensile strength can be raised in Examples 1 and 2, in which 15 to 40 weight % of glass fibers are added, as compared with Comparison 1 in which no glass fiber is added. Thus, in the high-temperature circumstance of about 200° C. or higher, it is possible to prevent the breakage of the thin portion 100*a* or the like, as might be liable to occur when the ignition plug 2 is extracted from the plug hole.

Here, the filler to be added to the case 100 of the present embodiment is exemplified by the glass fibers, but an inorganic filler such as talc, calcium carbonate or mica, or an organic filler such as carbon fibers or aramid fibers can be used. Moreover, the filler may be blended with another additive such as an oxidation inhibitor, an internal mold lubricant or an elastomer.

Next, the aforementioned high-temperature dielectric durability tests of Example 1 and Comparison 2 will be described with reference to FIGS. 2 and 3.

Figure 2:
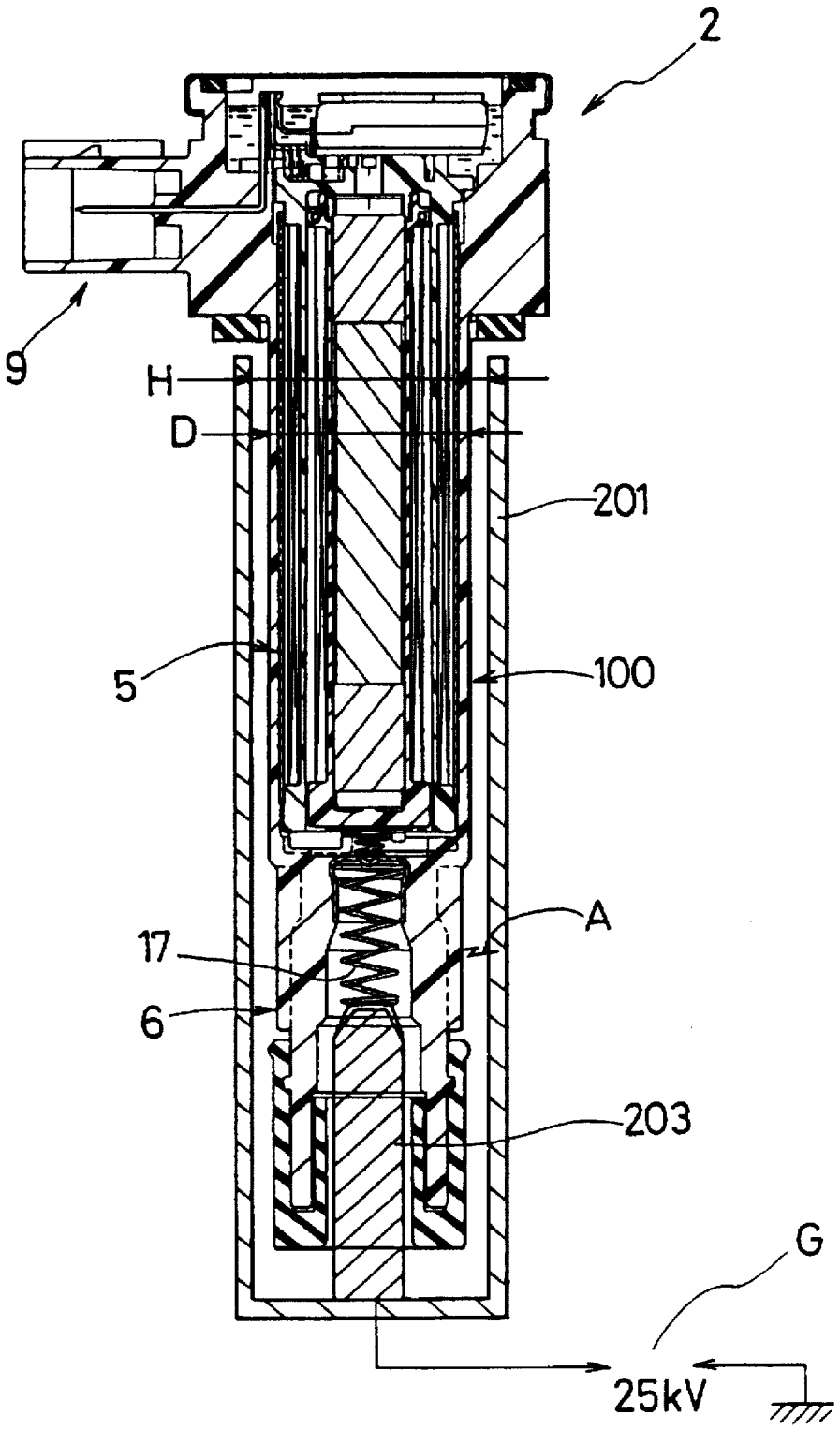
FIG. 2 is a schematic construction diagram showing a testing system for testing the ignition coil on a high temperature dielectric durability.

The high-temperature dielectric durability tests were conducted by the ignition coil testing system, as shown in FIG. 2.

The case 100 of the ignition coil 2, as used for these tests, has an external diameter D of 23 mm, and a metallic bottomed cylindrical jig 201, as imagined as a plug tube of the internal combustion engine, is set to have an internal diameter H of 24 mm. Moreover, a metallic plug jig 203, as imagined as the ignition plug, is so inserted into the cylindrical portion 105 as to contact with the spring 17. The plug jig 203 is so fixed in the bottom of the cylindrical jig 201 as to be electrically isolated from the cylindrical jig 201, and is electrically connected with a spark gap G which can effect the spark discharge when fed with a voltage of about 25 KV.

In FIG. 3, the results of the high-temperature dielectric durability tests which were conducted in the atmosphere of about 120° C. by that testing system. In these tests, it was evaluated whether or not the high voltage to be fed to the plug jig 203 by the transformer portion 5 of the ignition coil 2 caused a dielectric breakage in the portion, as indicated at A in FIG. 2, to discharge the cylindrical jig 201. The sample number was five.

It has been confirmed from the test results, as seen from FIG. 3, that the dielectric breakage did not occur for 1,000 hours or more in Example 1 whereas the dielectric breakdown occurred in the portion A for a short time period in Comparison 2. As a result, the PPS has a better dielectric durability than the PBT so that a predetermined dielectric durability can be achieved in the high-temperature circumstance by using the PPS as the material for the case 100 of the ignition coil 2.

Next, the injection molding tests of the case 100 by Examples 1 and 2 and Comparison 2 will be described with reference to FIG. 4. The injection molding tests were conducted by the testing system of the case 100, as shown in FIG. 4.

Figure 4:
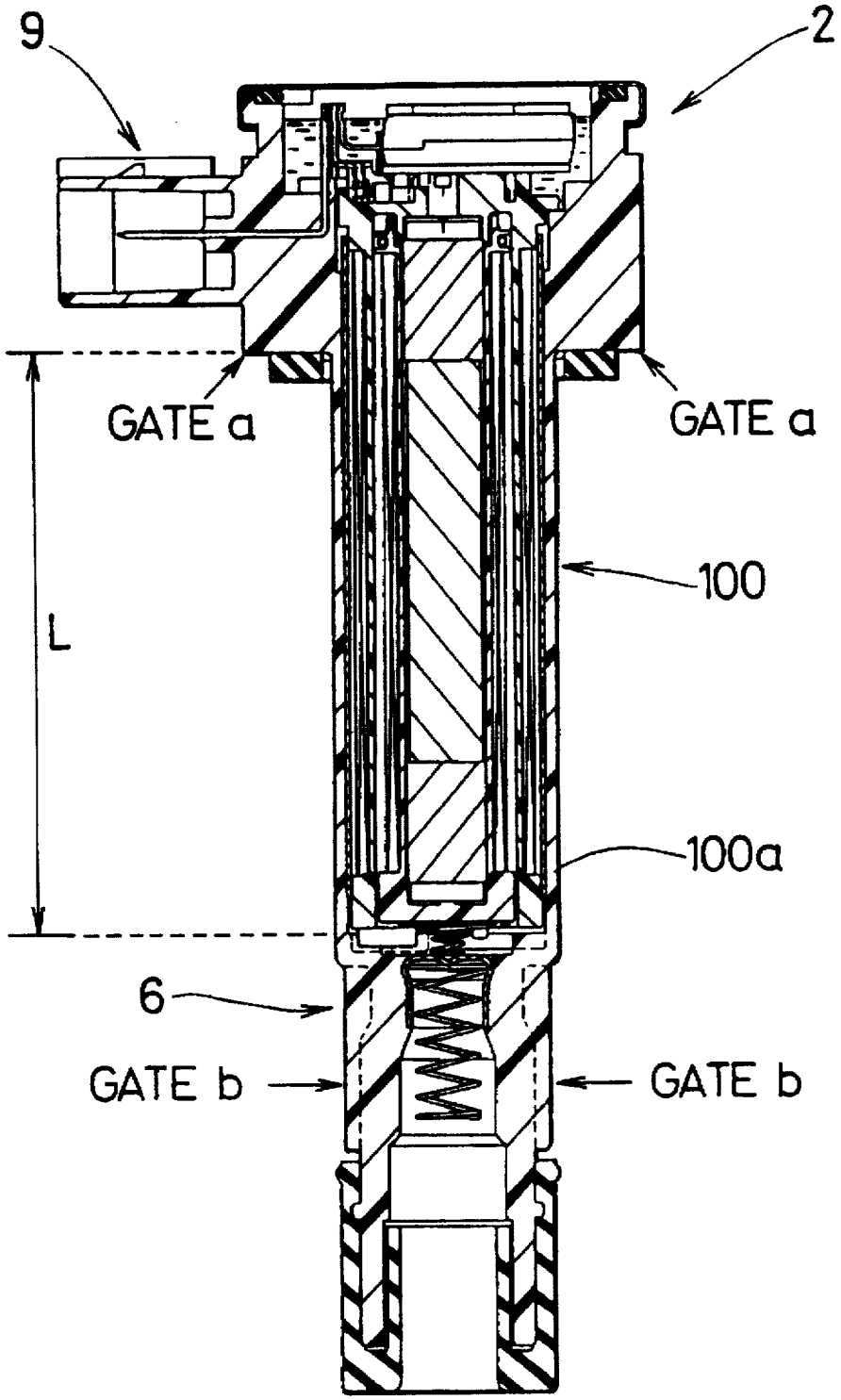
FIG. 4 is a schematic construction diagram showing a testing system for testing the injection molding of the case of the ignition coil.

Gates are so formed in the not-shown mold used in these tests as to inject the molten material from four portions and are represented by gates a and b in FIG. 4. Reference letter L in FIG. 4 indicates the axial length of the thin portion 100*a* (having a thickness of 1 to 1.3 mm) of the case 100 and is set to 100 mm in the present tests.

By this testing system, the injection molding tests were separately conducted in the case of two point gates, in which the injection was made only from the gates a, as located at the side of the control signal connector 9 of the case 100, and in the case of four point gates in which the injection was made not only from the gates a but also from the gates b, as located at the side of the joint portion 6, and it was evaluated whether or not the case 100 could be molded without any molding defect as its entirety. The "PPS filler 60" in FIG. 3 indicates the PPS to which was added 60 weight % of inorganic filler.

The results of these tests have revealed, as seen from FIG. 3, that for the four point gate, Examples 1 and 2 and Comparison 3 could individually mold satisfactorily (○) whereas for the two point gate Example 1 could mold satisfactory but Example 2 and Comparison 2 could mold with more or less deterioration (Δ or x). Thus, the molding states of the case 100 were different between the cases of the two point gate and the four point gates. This is, in addition to the causes of the flow direction and the distance of the molten material, because the glass fibers or the like were so added that the thin portion 100*a* of the case 100 might not lose the shape holdability and because the fluidicity of the molten material was lowered by the glass fibers or the like to be added. Thus, according to Example 1, the case 100 can be satisfactorily molded even only through the gates a, as positioned at the side of the control signal connector 9 of the case 100. If more or less deterioration is allowed, on the other hand, the injection molding can also be effected only through the gates a according to Example 2.

According to the present embodiment, the case 100 of the ignition coil 2 is made of the PPS so that the dielectric durability can be improved better than the case in which the PBT or PET is used as the material for the case 100, and the predetermined amount of glass fibers is added to the PPS so that the tensile strength in the high-temperature circumstance can be increased. As a result, there can be achieved an effect to improve the dielectric durability in the high-temperature circumstance to prevent the problem of the cracking of the relatively thin portion.

According to the present embodiment, moreover, the cup 15, the spring 17 and the terminal plate 34 are sealed therearound against the high tension by the joint portion 6 which is integrated with the case 100. As a result, there can be achieved an effect that the amount of relatively expensive silicone rubber to be used can be reduced more than the case the joint portion 6 is made of silicone rubber or the like separately of the case 100.

According to the present embodiment, still moreover, 15 to 40 weight % of filler is added to the PPS to make the case 100. As a result, there can be achieved an effect that the shape holdability of the case 100 can be retained even in the high-temperature circumstance such as the overheat of the internal combustion engine. In addition, the filler is added to such an extent as to cause no molding defect of the case 100 to be injection-molded. As a result, there can be attained an effect that the case 100 containing an additional filler can be injection-molded without increasing the gate number of the injection mold.

Here, the case 100 of the present embodiment is made of the PPS which is the most desirable of the materials, but the present invention should not be limited thereto but may use a polymer alloy of the PPS and polyphenylene oxide, for example. This material may also be exemplified by polyarylate, polyether imide or a liquid crystal polymer, or a polymer alloy containing a plurality of the PPS, polyphenylene oxide, polyarylate, polyether imide and a liquid crystal polymer.

Other modifications and alterations to the embodiment will be possible to those skilled in the art without departing from the spirit and scope of the invention.

What is claimed is:

1. An ignition coil for an internal combustion engine comprising:

a housing filled with an insulating oil and mountable on the internal combustion engine;

a coil portion disposed within the insulating oil in the housing;

the housing being molded of a material which contains at least one of polyphenylene sulfide, polyphenylene oxide, polyarylate, polyether imide and a liquid crystal polymer, and a glass fiber reinforcing filler added in an amount of about 15 weight %, based on 100 weight % of the material.

2. An ignition coil for an internal combustion engine according to claim 1, wherein:

the coil portion has a secondary voltage output portion with an outer surface; and the housing has a joint portion integrated therewith and insulating the surrounding of the outer surface of the secondary voltage output portion of the coil portion.

3. An ignition coil for an internal combustion engine according to claim 2, wherein:

the housing is formed into a cylindrical shape to be fitted in a plug hole of the engine.

4. An ignition coil for an internal combustion engine according to claim 3, wherein:

the material contains polyphenylene sulfide and has a thermal deformation temperature of above 200° C. under the condition of 4.6 $Kg/cm^2$ according to the standard testing method D648, as regulated by American Society for Testing Materials.

5. An ignition coil for an internal combustion engine comprising:

a housing filled with an insulating oil and mountable on the internal combustion engine;

a coil portion disposed within the insulating oil in the housing;

the housing being molded of a material which contains at least one of polyphenylene sulfide, polyphenylene oxide, polyarylate, polyether imide and a liquid crystal polymer, and a reinforcing filler added in an amount of 15 to 40 weight %, based on 100 weight % of the material; and the housing being formed into a cylindrical shape to be fitted in a plug hole of the engine, and molded by supplying the material through a plurality of molding gates.

6. An ignition coil for an internal combustion engine according to claim 5, wherein:

the coil portion has a secondary voltage output portion with an outer surface; and the housing has a joint portion integrated therewith and insulating the surrounding of the outer surface of the secondary voltage output portion of the coil portion.

7. An ignition coil for an internal combustion engine according to claim 5, wherein:

the material contains polyphenylene sulfide with the reinforcing filler.

8. An ignition coil for an internal combustion engine according to claim 5, wherein:

the housing further comprises first and second longitudinal end portions; and the molding gates are provided near the first and second longitudinal end portions.

9. An ignition coil for an internal combustion engine according to claim 8, wherein:

the housing has a wall thickness of about 1 mm.

* * * * *